United States Patent [19]

Onomoto et al.

[11] Patent Number: 5,046,790

[45] Date of Patent: Sep. 10, 1991

[54] APPARATUS FOR IMMOBILIZING MOVABLE CABINET

[75] Inventors: Ryuichi Onomoto, Kusatsu, Japan; Masaru Sato, Atsugi; Ryuichi Onomoto, Kusatsu, all of Japan; Hiroshi Fujikura, Yokohama

[73] Assignees: International Business Machines Corporation, Armonk, N.Y.; Omron Tateisi Electronics Co., Kyoto, Japan

[21] Appl. No.: 308,772

[22] Filed: Feb. 10, 1989

[30] Foreign Application Priority Data

Feb. 15, 1988 [JP] Japan ..... 63-32581

[51] Int. Cl.[5] ..... A47B 91/00

[52] U.S. Cl. ..... 312/250; 312/348; 312/254; 312/255

[58] Field of Search ..... 312/348, 253, 254, 255, 312/250, 256

[56] References Cited

U.S. PATENT DOCUMENTS

| | | | |
|---|---|---|---|
| 849,999 | 4/1907 | Hendricks | 312/250 |
| 2,299,688 | 10/1942 | Ferris | 312/250 |
| 2,503,020 | 4/1950 | Bailey | 312/253 X |
| 2,803,510 | 8/1957 | Carbary | 312/253 |
| 3,482,894 | 12/1969 | Pryor | 312/250 |
| 4,196,953 | 4/1980 | Krakow | 312/256 |
| 4,784,446 | 11/1988 | Newhouse | 312/250 X |

*Primary Examiner*—Joseph Falk

*Attorney, Agent, or Firm*—Dickstein, Shapiro & Morin

[57] ABSTRACT

An apparatus for immobilizing a movable cabinet (1) including an apparatus body (2) capable of being housed in the cabinet and of being drawn out therefrom, a first caster (3) disposed on a rear bottom surface of the cabinet, a second caster (4) disposed on a front bottom surface of the cabinet, and a leg member (5) disposed on a front bottom surface of the cabinet. The total number of the first and second casters is at least three, and by means of these casters, the cabinet is movable with the apparatus body housed therein. In a lower end of the leg member, there is disposed a flat plate (5*b*) to be brought into contact with a floor surface to establish an areal contact. The leg member is capable of projecting to a position below a lower end of the second caster of the apparatus body housed in the cabinet. By projecting the leg member, the cabinet is retained in a stationary state. The leg member is also capable of retracting to a position above a lower end of the second caster. When the leg member is retracted, the cabinet is set to the movable state.

2 Claims, 6 Drawing Sheets

APPARATUS FOR IMMOBILIZING MOVABLE CABINET

BACKGROUND OF THE INVENTION

1. Field of the Invention

The present invention relates to an apparatus for immobilizing a movable cabinet, a body of said apparatus being housed in the cabinet so as to be drawn therefrom, and for example, to an apparatus for immobilizing a cabinet of a bill deposit and dispense machine of a type to be installed in a bank so as to be used by clerks.

2. Description of the Prior Art

FIG. 6 shows a cabinet and a body of the apparatus drawn therefrom. On an inner surface of a side plate of a cabinet 51, there is fixedly secured a support rail 53. In contrast thereto, on a side surface of the apparatus body 52, there is fixed a slide member 54, which slidably engages with the rail 53 in a longitudinal direction thereof. In the four corner positions of the bottom surface of the apparatus body 52, there are attached four casters 57, respectively. The apparatus body 52 is inserted from an opening of an end of the cabinet 51 so as to be housed therein; furthermore, the apparatus body 52 can be drawn therefrom when the slide member 54 slides along the rail 53 so that the casters 57 move through rotating motion thereof on a floor surface.

On the other hand, the cabinet 51 is provided with casters 55 each having a stopper in the four corner positions in the bottom surface. When the cabinet 51 is installed at a predetermined position, a stopper lever 56 is operated to cause the stopper to act upon each caster 55, thereby preventing unnecessary movement of the cabinet 51.

However, there has been a problem that when the apparatus body 52 is subjected to a housing or drawing operation, it is likely that the cabinet 51 is also moved toward the direction in which the apparatus body 52 moves. Since the cabinet 51 is of a light weight and the apparatus body 52 is heavy, the cabinet 51 easily moves together with the movement of the apparatus body 52 (in the housing or drawing operation). In addition, although the caster 55 of the cabinet 51 is provided with a stopper, since a contact surface to be brought into contact with the floor surface is a curved surface, the statical friction is small and the cabinet 51 easily slides thereon. Moreover, the cabinet 51 is provided with four casters 55 and the apparatus body 52 is also provided with four casters 57, namely, a large number of casters are employed; in consequence, it requires a complicated operation to adjust the height of the casters when the apparatus body 52 is drawn.

SUMMARY OF THE INVENTION

It is therefore an object of the present invention to provide an immmobilizing apparatus of a relatively simple structure which can securely immobilize a cabinet without necessitating the adjustment of the height of the casters.

According to the present invention, in a cabinet having an apparatus body drawably housed in the cabinet, there are provided a first caster disposed on a rear bottom surface of the cabinet, a second caster disposed on a front bottom surface of the cabinet, and leg members disposed on a front bottom surface of the cabinet. The total number of the first and second casters is at least three. With provisions of these casters, in a state where the apparatus body is housed in the cabinet, the cabinet is movable. The leg member is provided at lower end therof with a flat plate to be brought into contact with a floor surface. In addition, the leg member can be projected down to a position below the lower end of the second caster of the apparatus body housed in the cabinet and can be extracted up to a position above the lower end of the second caster.

According to the present invention, by housing the apparatus body in the cabinet and by moving the leg members up to a position above the lower end of the second caster, the cabinet can be moved through a rotating movement of the first and second casters.

Furthermore, in order to set the cabinet in which the apparatus body is housed to a predetermined position, the leg membesr need only be projected to a position such that the second caster of the apparatus body is slightly separated from the floor surface. As a result, the weight of the apparatus body is applied onto the leg members, and since each leg member has a flat plate to be brought into contact with the floor surface, there appears a large statical friction between the flat plate and the floor surface, which enables the cabinet to be securedly immobilized.

In this fashion, only by adjusting the amount of the proceeding or retracting operation of the leg members, the cabinet can be moved or immobilized.

In addition, in a case where the apparatus body is drawn from the cabinet in the stationary state into the outside, since the apparatus body is heavy, the apparatus body thus drawn and the cabinet are kept in the stationary state by the second caster of the apparatus body and the leg members of the cabinet. The adjustment of the height of the casters is unnecessitated.

BRIEF DESCRIPTION OF THE DRAWINGS

The present invention will be apparent from the following detailed description taken in conjunction with the accompanying drawings in which.

DESCRIPTION OF THE PREFERRED EMBODIMENTS

Description will be given in detail of an embodiment in which the present invention is applied to a bill deposit and dispense machine.

The bill deposit and dispense machine is installed in a bank or the like for usages therein such that a clerk inserts therein bills for a depositing transaction or bills are discharged therefrom for a payment transaction. The bills inserted into the machine are checked for the number of bills as well as for the kinds of bills so as to count the total amount thereof; and finally, the bills are stored in cartridges according to bill kinds in the machine. Bills to be paid are fed from the cartridges so as to be ejected from a discharge outlet. The bill deposit and dispense machine is connected to other terminals (including a terminal to input an amount and an account number and a terminal to read data from a passbook and to print transaction data on the passbook) and a main controller such that the machine operates under control of the main controller based on data inputted from these terminals.

The bill deposit and dispense machine is configured to be shared between two tellers. For the two tellers, two desks are respectively located on the right and left sides of the machine, and the terminals are installed on each desk. These clerks operate the bill deposit and dispense machine from the right and left positions, respectively.

Figure 1:
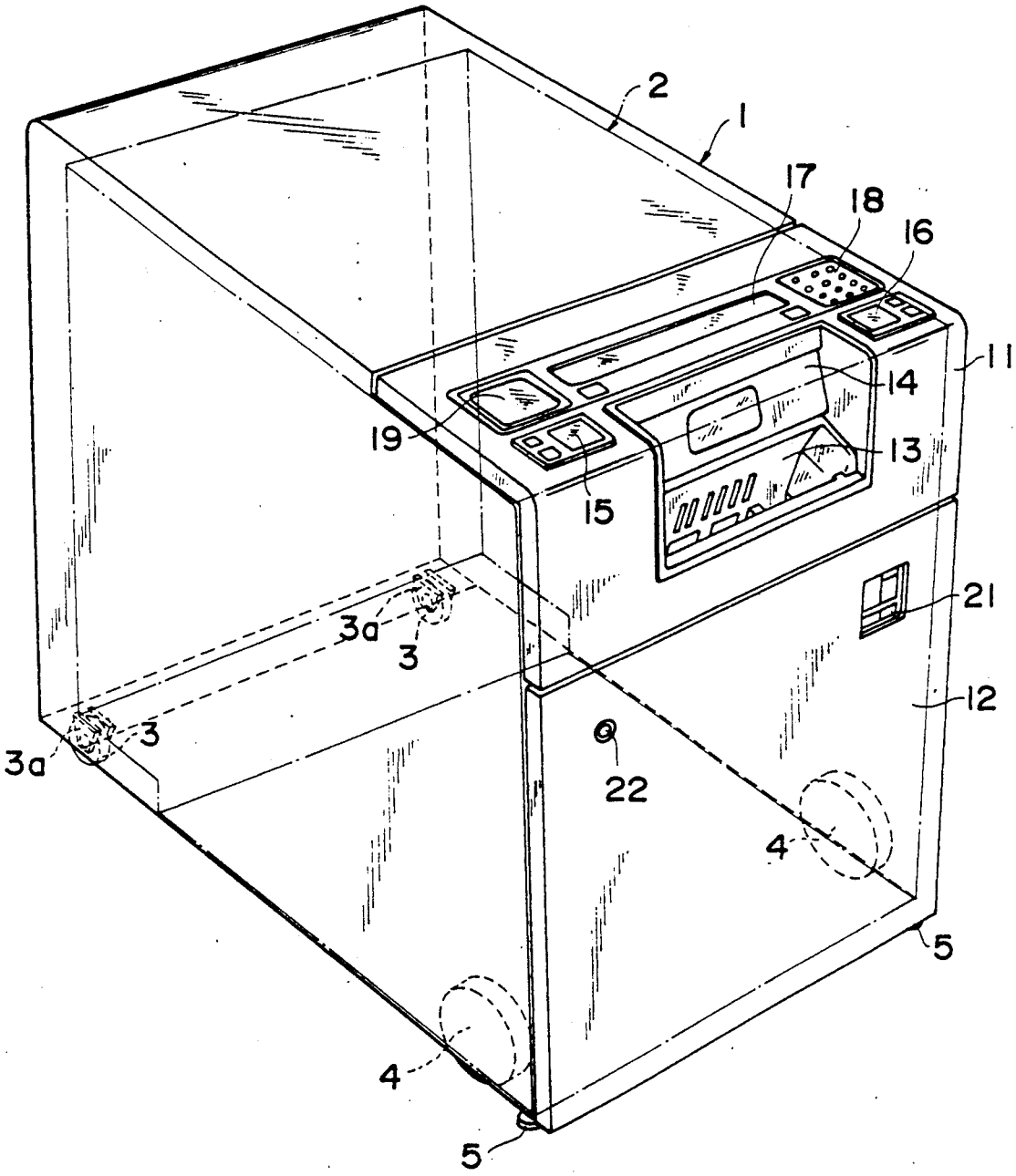
FIG. 1 is a perspective view showing an appearance of a bill deposit and dispense machine.
Figure 2:
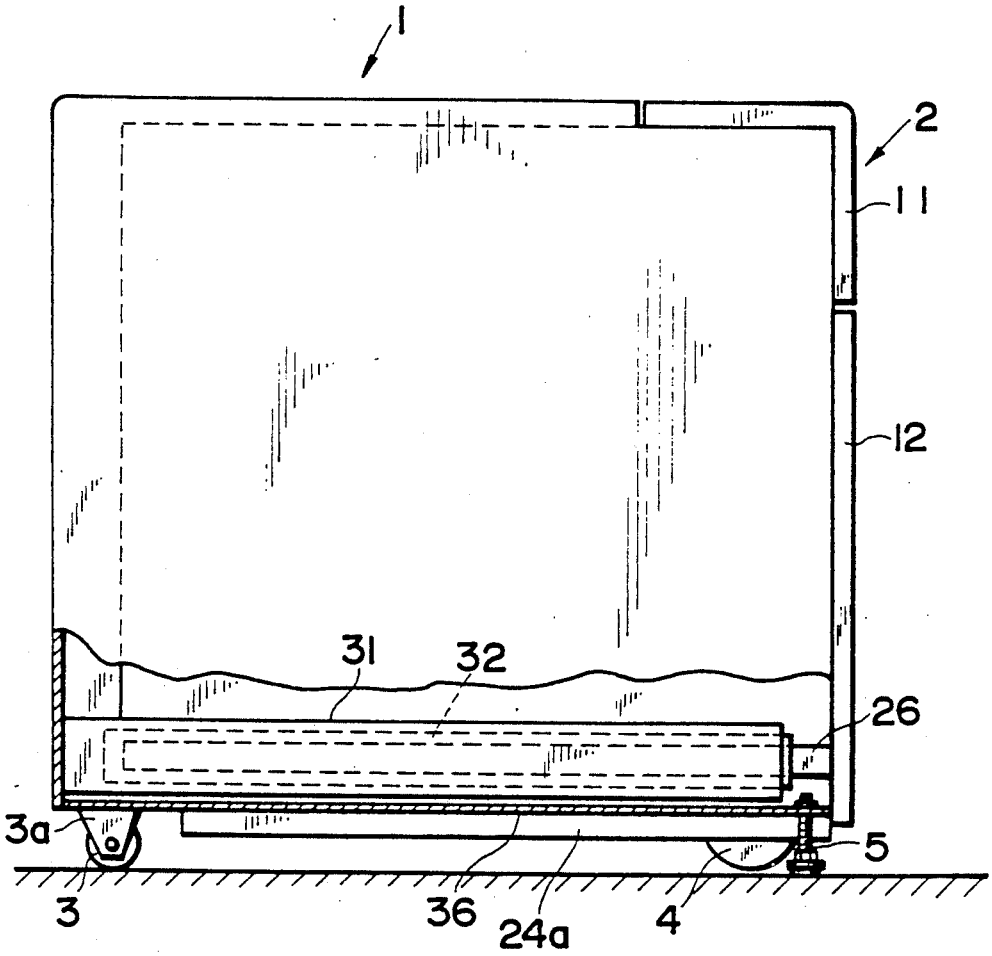
FIG. 2 is a partially cut-away side view of the bill deposit and dispense machine.
Figure 3:
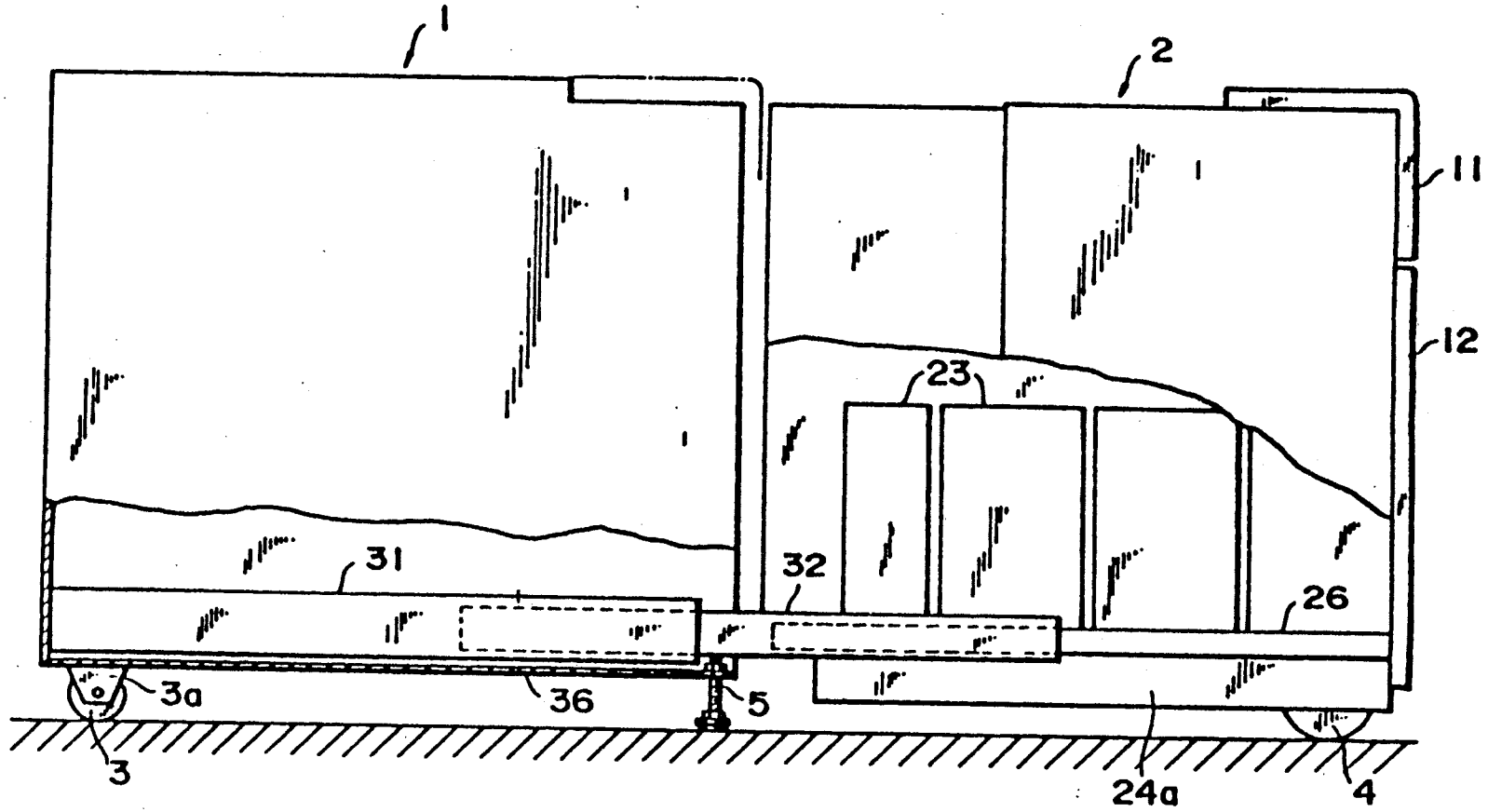
FIG. 3 is a partially cut-away side view showing the machine in a state where the apparatus body is drawn from the cabinet.

Referring to FIGS. 1 to 3, the bill deposit and dispense machine includes a cabinet 1 and a machine body 2. The cabinet 1 is a box or a frame having a shape of a parallelepiped and is open in the front and bottom sides. The machine body 2 is housed in the cabinet 1 so as to be drawn from the opening of the front side into the outside, which will be described later.

The machine body 2 are provided with an upper panel 11 in an upper portion of the front section and a lower panel 12 in a lower portion of the front section. The upper panel 11 is provided with a bill insert inlet 13, a bill discharge outlet 14 having a shutter, a left start key 15 to be employed by the clerk on the left side to start the depositing and withdrawal operations, a right start key 16 to be employed by the clerk on the right side to start the depositing and withdrawal operations, a display 17 to dispay various messages, a ten-key pad 18 to set various modes, and an error display 19 to display positions of a paper jam and the like. The lower panel 12 can be freely opened and closed and is provided with a reset key 21 and a key 22 for the open and close the panel 12. It is possible to open the lower panel 12 to draw a bill storing cartridge 23 disposed in the body toward the forward direction.

In the left and right positions of a bottom surface member disposed only in the rear section of the cabinet 1, there is fixed brackets 3*a* to which rear casters 3 are rotably attached. In the left and right sides of the lower portion of the front section of the cabinet 1, there is disposed leg members 5 to project downward and to retract upward, which will be described later. In addition, in a lower portion of the front section of the machine body 1, there is rotably disposed front casters 4 on the right and left sides thereof.

Figure 4:
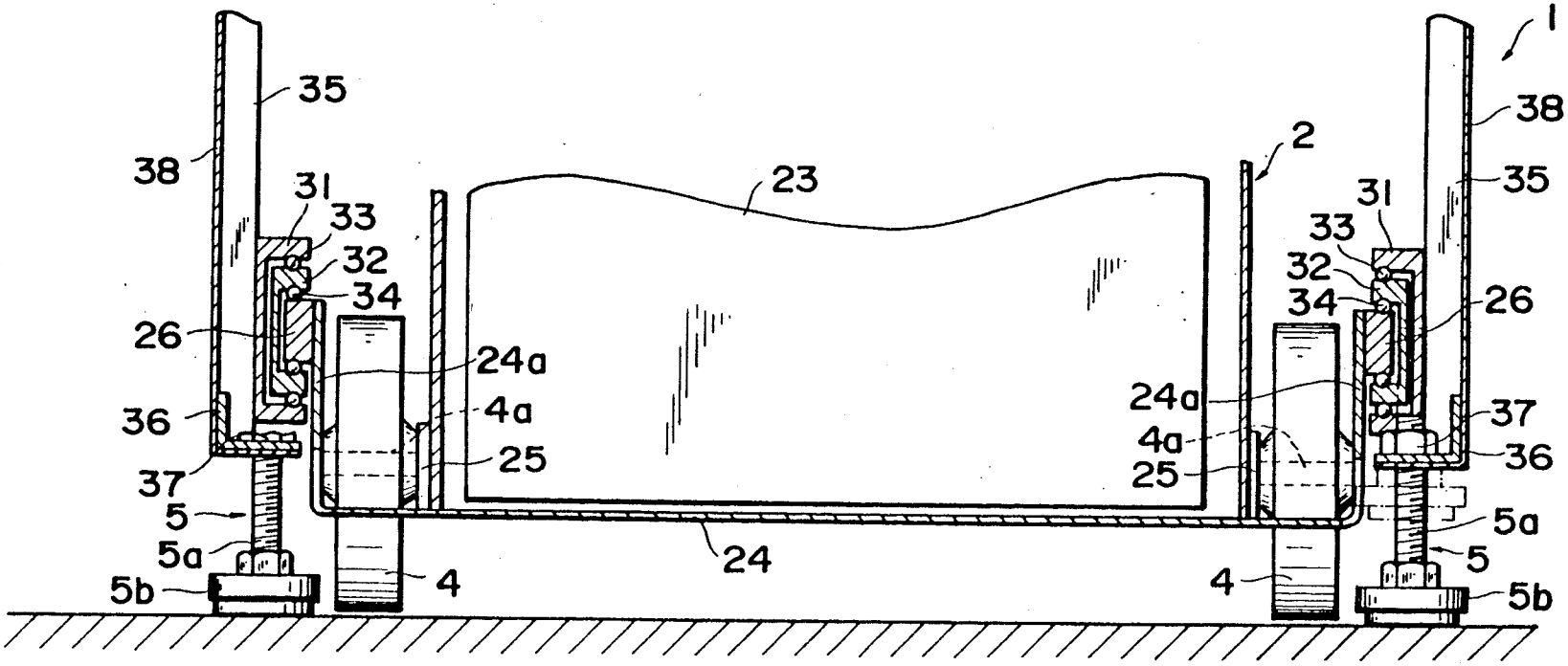
FIG. 4 is a diagram showing a pportion of a magnified cross-sectional view of the machine.
Figure 5:
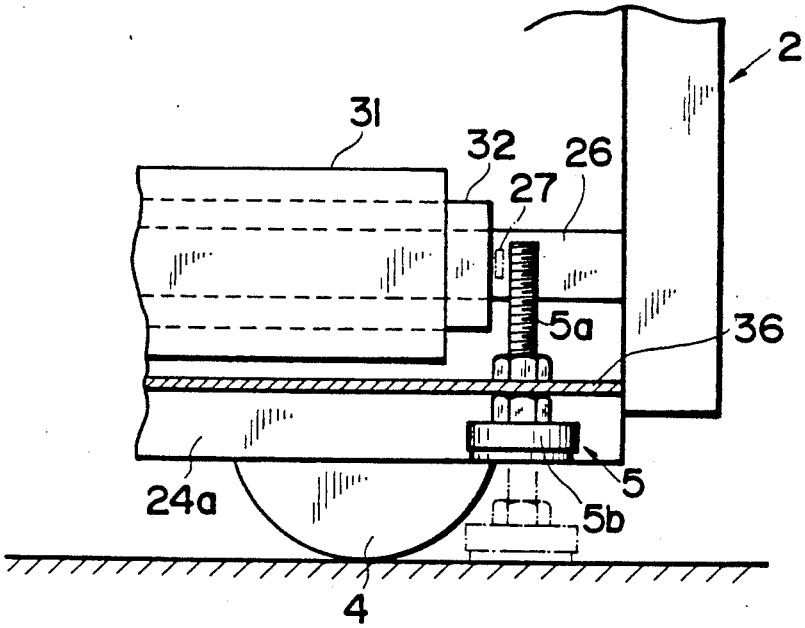
FIG. 5 is a magnified cross-sectional view showing relationships between the leg members and the rail.
Figure 6:
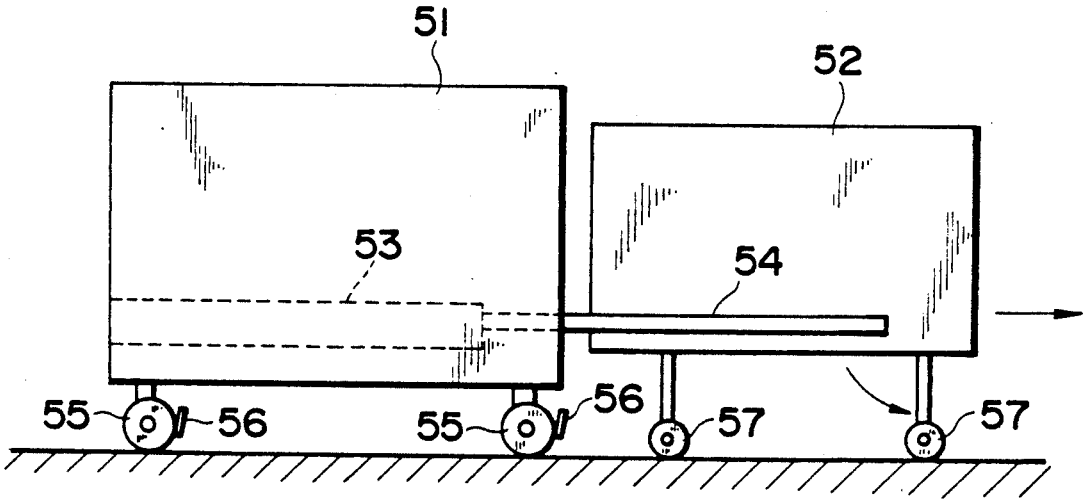
Fig.6 PRIOR ART
FIG. 6 is a side view of a conventional example of the machine showing a state where the apparatus body is drawn from the cabinet.

In addition, referring to FIGS. 4 and 5, the side surfaces of the cabinet 1 include a frame and a side plate 38 fixed thereon. The frame includes a plurality of vertical members 35 and a horizontal member 36 linking bottom ends of these vertical members 35. A first rail 31 which has substantially a U shape in a cross-sectional plane thereof and which horizontally extends in the forward and backward directions is fixedly secured on the vertical members 35 at inner bottom portions of the side surface of the cabinet 1. A second rail 32 similarly having a substantially U shape in a cross-sectional plane thereof is engaged via balls 33 with the first rail 31 so as to be slidable in the longitudinal direction of the first rail 31. On the other hand, a bottom plate 24 constituting the frame of the machine body 2 rises at both sides thereof so as to form support sections 24*a*. On an outer surface of the support section 24*a*, there is fixed a slid member 26 which horizontally extends in the forward and backward directions. The slide member 26 is received via balls 34 onto the second rail 32 so as to be slidable in the longitudinal direction of the second rail 32. With the provision of the configurations above, the machine body 2 is supported onto the cabinet 1 so as to be slidable in the forward and backward directions (for the drawing and housing operations).

The leg member 5 comprises a screw rod 5*a* and a flat plate 5*b* attached to a bottom end of the screw rod 5*a*. The flat plate 5*b* is capable of being brought into contact with a floor surface to establish an areal contact. It is preferable to attach a friction plate on the bottom surface of the flat plate 5*b*. On the other hand, in a front end portion of a horizontal member 36 constituting the cabinet 1, there is bored a hole in which a nut 37 is fixedly secured. The screw rod 5*a* of the leg member 5 is passed through the hole so as to be engaged with the nut 37. By rotating the screw rod 5*a*, the leg member 5 is vertically moved (extended or retracted.)

Furthermore, in the both sides of the front portion of the body 2, there are fixedly secured brackets 25 on the bottom plate 24 such that front casters 4 each are rotably mounted on a shaft 4*a* between the bracket 25 and the support sections 24*a*.

In the configuration above, when the bill deposit and dispense machine is to be moved, as shown in FIG. 5, the leg member 5 is retracted such that the lower end thereof is located at a position above the lower end of the front caster 4. As a restul, the machine is supported by the front and rear casters 3 and 4 and is set to the movable state.

The screw rod 5*a* of the leg member 5 at the retracted (raised) position projects toward the front side of the second rail 32, which prevents the second rail 32 from sliding toward the forward direction. Desirably, there is provided a mechanism to lock the slide member 26 onto the second rail 32 in the state where the machine body 2 is housed in the cabinet 1. The lock mechanism is configured as follows. That is, when the machine body 2 is drawn out therefrom, the second rail 32 first slides in the forward direction, so that at a point where the second rail 32 reaches the draw limit position, the locked state established between the secnd rail 32 and the slide member 26 is released. Alternatively, as indicated by a broken line, a stopper 27 is disposed in the slide member 26 so as to engage with the projected screw rod 5*a*. With the provision of the stopper 27, it can be prevented in an operation to move the the machine that the machine body 2 is mistakenly drawn out from the cabinet 1.

In order to install the bill deposit and dispense machine at a predetermined position, the leg member 5 is adjusted as shown in FIG. 2 such that the lower end thereof is projected to a position below the lower end of the second caster 4. The second caster 4 is slightly separated from the floor surface, which causes the machine to be supported by the first caster 3 and the leg member 5. Since a flat plate 5*b* is fixed on the lower end of the leg member 5 and the flat plate 5*b* is brought into contact with a broad area of the floor surface; furthermore, the leg member 5 receives the weight of the machine body 2, there appears a large statical frictional force to securedly retain the machine in a stationary state.

When the leg member 5 projects downwards, the linkage between the screw rod 5*a* and the front end of the second rail 32 or the stopper 27 of the slide member 26 is freed and hence the machine body 2 becomes to be drawable from the cabinet 1. Since the machine is immobilized and is sustained in the stationary state as described above, even if the machine body 2 is drawn out from the cabinet 1 in this situation or is houses therein, the cabinet 1 is not moved.

In the immobilize state of the cabinet 1, when the machine body 2 is drawn in the forward direction from the cabinet 1, the second caster 4 is brought into contact with the floor surface as shown in FIG. 3, namely, the machine body 2 is then supported by the leg member 5 and the second caster 4. Since the cabinet 1 is smaller in the weight than the machine body 2, there may appear a case where the first caster 3 of the cabinet 1 leaves from the floor surface or a case where the rails 31 and 32 and the slid member 26 slightly bend such that the first and second casters 3 and 4 are brought into contact with the floor surface. In either case, since the leg member 5 is brought into contact with the floor surface, the machine body 2 is sustained in the stationary state. In this state, the machine body 2 undergoes the maintenance, inspection, and the like. Favorably, in order to limit the lenght by which the second rail 32 is drawn out, there is disposed a stopper between the first rail 31 and the second rail 32; furthermore, in order to limit the lenght by which the slide member 26 is drawn out, there is disposed a stopper between the slide member 26 and the second rail 32.

We claim:

1. An apparatus for immobilizing a movable cabinet comprising:

an apparatus body capable of being housed in the cabinet and of being drawn out therefrom;

a first caster means disposed on a rear bottom surface of the cabinet;

a second caster means disposed on a front bottom surface of the cabinet, said first and second caster means being at least three in number by means of which the cabinet is movable with the apparatus body housed therein;

a leg member disposed on a front bottom surface of the cabinet, said leg member being capable of projecting to a position below a lower end of said second caster means of the apparatus body housed in the cabinet and being capable of retracting to a position above a lower end of said second caster means;

rails disposed on the cabinet;

a slide member fixed on said apparatus body and slidably engaged with said rails in a longitudinal direction thereof; and means for retracting said leg member in a direction toward at least one of said slide member and said rail such that a portion thereof engages with a portion of said one of said slide member and said rail so as to prevent said apparatus body from being drawn out from the cabinet.

2. An apparatus according to claim 1 further including a flat plate attached to a lower end of said leg member so as to be brought into contact with a floor surface.

* * * * *